US009259038B2

(12) United States Patent
Cholet et al.

(10) Patent No.: US 9,259,038 B2
(45) Date of Patent: Feb. 16, 2016

(54) BRA CUP AND METHOD FOR ITS MANUFACTURE

(71) Applicants: Gervais Cholet, Champillon (FR); Thierry Blin, Mancy (FR)

(72) Inventors: Gervais Cholet, Champillon (FR); Thierry Blin, Mancy (FR)

(73) Assignee: CHANTELLE, Cachan (FR)

( * ) Notice: Subject to any disclaimer, the term of this patent is extended or adjusted under 35 U.S.C. 154(b) by 0 days.

(21) Appl. No.: 14/332,130

(22) Filed: Jul. 15, 2014

(65) Prior Publication Data

US 2015/0017877 A1 Jan. 15, 2015

(30) Foreign Application Priority Data

Jul. 15, 2013 (FR) ..... 13 56943

(51) Int. Cl.
*A41C 3/12* (2006.01)
*A41C 5/00* (2006.01)

(52) U.S. Cl.
CPC .. *A41C 3/12* (2013.01); *A41C 5/005* (2013.01)

(58) Field of Classification Search
CPC ..... A41C 3/10; A41C 3/14; A41C 3/144; A41C 3/148
USPC ..... 450/54–57, 37, 39; 2/267, 268; 623/7, 8
See application file for complete search history.

(56) References Cited

U.S. PATENT DOCUMENTS

| | | | | |
|---|---|---|---|---|
| 5,340,352 | A * | 8/1994 | Nakanishi et al. | 450/57 |
| 5,951,367 | A * | 9/1999 | Hsu | 450/57 |
| 6,036,577 | A * | 3/2000 | Coburn | 450/57 |
| 6,430,969 | B1 * | 8/2002 | Roell | 66/170 |
| 2002/0015729 | A1 * | 2/2002 | Watts | 424/462 |
| 2003/0101776 | A1 * | 6/2003 | Shirasaki et al. | 66/196 |
| 2004/0237599 | A1 * | 12/2004 | Kondou et al. | 66/202 |
| 2006/0081013 | A1 * | 4/2006 | Gross | 66/64 |
| 2009/0247047 | A1 | 10/2009 | Avalos-Dessner et al. | |
| 2010/0055381 | A1 * | 3/2010 | Yamaguchi et al. | 428/91 |

FOREIGN PATENT DOCUMENTS

| | | | |
|---|---|---|---|
| JP | 2000 248412 | A | 9/2000 |
| JP | 2004 256956 | A | 9/2004 |
| JP | 2011 137275 | A | 7/2011 |

OTHER PUBLICATIONS

Search report for related French Application No. 13 56943; report dated Mar. 7, 2013.

* cited by examiner

*Primary Examiner* — Gloria Hale
(74) *Attorney, Agent, or Firm* — Miller, Matthias & Hull LLP

(57) ABSTRACT

A bra cup molded by thermoforming comprises a layer of thermoformable polyurethane foam as well as an inner fabric and an outer fabric bonded to the foam layer. The outer fabric is composed of a three-dimensional knitted fabric comprising a first face and a second face separated from one another by a thickness of the three-dimensional knitted fabric that is greater than 1 mm. The method for manufacturing the cup comprises a molding step, and in a bonding step preceding the cup molding step, said first face and the foam layer are bonded together.

13 Claims, 2 Drawing Sheets

BRA CUP AND METHOD FOR ITS MANUFACTURE

CROSS-REFERENCE TO RELATED APPLICATION

This application claims priority under the Paris Convention to French Patent Application No. 13 56943 filed on Jul. 15, 2013

FIELD OF THE DISCLOSURE

The present invention relates to a bra cup molded by thermoforming, having a generally concave inner face and a generally convex outer face, comprising a layer of thermoformable polyurethane foam as well as an inner fabric and an outer fabric bonded to the foam layer on the inner face and outer face of the cup respectively.

BACKGROUND OF THE DISCLOSURE

A bra cup is also referred to as a breast cup. A bra cup or breast cup of this type is disclosed in the European patent application published under number EP1440626A1. With reference to FIG. 12 of that document, a bra molded by thermoforming is disclosed in which cups of thermoformed urethane foam (6, 11) are associated with a chest band 12. The assembly is placed in a mold between two sheets of fabric (15, 16) in order to adhere the sheets of fabric to the breast cups, as explained in paragraph 72 of the document.

The fabric 15 on the outer face of the cups can expand with the chest band 12. This fabric is conventionally thin, and has no elasticity depthwise. The fabric therefore has little effect on any sensation of softness experienced when touching the outer face of a cup, and said sensation is dependent on the mechanical properties of the elasticity of the outer sheet of foam 11.

A softer foam can be considered in order to improve the feel, but this solution can be difficult to reconcile with the relative cup firmness required in order to support the chest properly. Furthermore, for wearer comfort it is generally desirable for the fabric covering the foam to offer satisfactory stretchability, which can be incompatible with a very soft feel. It is therefore difficult with the conventionally used fabric to provide a pleasant feel combining flexibility, elasticity, and softness.

The present invention aims to overcome these disadvantages, and in particular aims to provide a thermoformed bra cup where the outer face is pleasantly soft.

SUMMARY OF THE DISCLOSURE

To this end, the invention relates to a bra cup as defined in the above introduction, characterized in that the outer fabric is composed of a three-dimensional knitted fabric comprising a first face and a second face separated from one another by a thickness of the three-dimensional knitted fabric that is greater than 1 mm.

A three-dimensional knitted fabric is a knitted fabric with a surface arranged to provide a resistant and relatively uniform three-dimensional knitted structure. It is thus possible to obtain a breathable fabric which retains little residue when washed and allows reducing the amount of laundry detergent required for washing as well as the fabric drying time.

The arrangements of the invention not only allow improving the soft feel of the outer face of a cup, but also improving the elasticity and resistance of the outer fabric in order to provide more comfortable chest support, without compromising the sturdiness of the bra.

In advantageous embodiments of a bra cup according to the invention, use is made of one or more of the following arrangements, possibly in combination:

the thickness of the three-dimensional knitted fabric is between 2.5 mm and 4 mm, which provides a particularly soft feel;

the foam layer is compressible and is formed of a single piece, thereby making it possible to mold the foam of a cup to the desired shape using a single piece of foam;

the foam layer has a density and a thickness which vary in different areas of the cup, said foam layer being formed from a layer of compressible foam of a generally uniform thickness that is compressed to a greater or lesser extent depending on said areas of the cup.

The invention also relates to a method for manufacturing a bra cup, comprising a step of molding the cup within a mold by thermoforming a composite assembly which comprises a layer of thermoformable polyurethane foam as well as an inner fabric and an outer fabric located on either side of the foam layer, characterized in that the outer fabric is composed of a three-dimensional knitted fabric comprising a first face and a second face separated from each other by a thickness of the three-dimensional knitted fabric that is greater than 1 mm, and in that in a bonding step preceding the cup molding step, said first face and the foam layer are bonded together.

By these arrangements, the manufacture of a bra cup, or of an integral assembly of two cups formed by molding a single composite assembly, requires only one molding step in which the mold is brought to a high temperature in order to thermoform the foam. In comparison, the manufacturing method disclosed in EP1440626A1 first requires heating the mold for thermoforming and fusing two sheets of foam (6 and 11, see paragraph 64), and subsequently heating the mold to bond the two layers of fabric to the cups.

In advantageous embodiments of a method for manufacturing a bra cup according to the invention, one or more of the following arrangements may be used, possibly in combination:

the composite assembly used is in laminate form, and the foam layer and the three-dimensional knitted fabric of said composite assembly each have a generally uniform thickness, enabling the preparation by lamination of a large laminate surface which will be cut into a plurality of identical basic surfaces each to be used in molding a cup or an integral assembly of two cups;

the mold has a shape that is suitable for the final shape of the cup, which allows obtaining the desired shape without needing to reshape the cup after molding;

the shape of the mold is adapted to compress the composite assembly to a greater or lesser extent in predetermined areas, so that the thickness of the foam layer of the cup varies according to said predetermined areas, which allows obtaining a cup with contoured padding out of a composite assembly of foam of uniform thickness;

during the bonding step, a hot melt adhesive is applied in a distributed manner onto the first face of the three-dimensional knitted fabric so as to form dots of adhesive with space between them, the foam layer is laminated with the three-dimensional knitted fabric, and the composite assembly is left at room temperature for at least a predetermined period before the cup molding step, the hot melt adhesive being such that, after said predetermined period, the adhesive is not reactivated during the thermoforming of the composite assembly, which provides a bonding that does not interfere with the elasticity or breathability of the cup;

during the bonding step, the hot melt adhesive is applied onto the first face of the three-dimensional knitted fabric by means of a roller containing the molten adhesive, the roller having a cylindrical wall provided with adhesive dispensing holes distributed so as to form the dots of adhesive, resulting in regularly spaced dots of adhesive.

BRIEF DESCRIPTION OF THE DRAWINGS

Other features and advantages will be apparent from the following description of some non-limiting examples, with reference to the figures in which.

DETAIL DESCRIPTION OF THE DISCLOSURE

Figure 1:
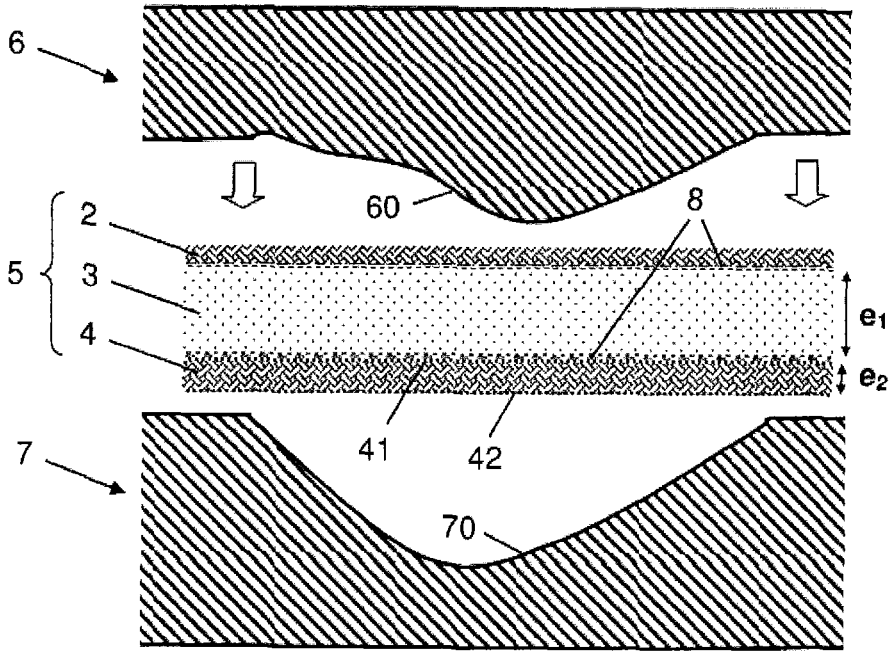
FIG. 1 schematically represents a sectional view of a composite assembly ready to be molded to create a bra cup according to a first embodiment of the invention where the cup comprises contoured padding.

In FIG. 1, a composite assembly 5 in the laminate form is ready to be molded within a mold containing two cavities 6 and 7. The laminate 5 comprises a foam layer 3 of thermoformable polyurethane, as well as an inner fabric 2 and an outer fabric 4 located on either side of the foam layer 3. The inner fabric 2 and the outer fabric 4 were each previously bonded to the foam layer 3, for example by a laminating method with application of a hot melt adhesive of thermoplastic polymer containing no water or organic solvents.

A layer of discontinuous adhesive coating 8 is formed on each face of the foam layer 3, for example composed of dots of adhesive spaced regularly apart so that the laminate 5 retains good breathability. Of course, the bonding may be achieved by other methods suitable for a discontinuous application, in particular such as spraying on the adhesive. The foam layer 3 is of polyurethane and provides mechanical and physical properties that give the molded assembly good elastic recovery and good breathability. Polyurethane is preferred over most other known materials for foam, in particular because of its excellence for bonding to fabric coverings. In comparison, polyethylene foam generally does not allow bonding a fabric covering using the above techniques.

The outer fabric 4 is composed of a three-dimensional knitted fabric, which comprises a first face 41 bonded to the foam layer 3 and a second face 42 that will form the outer face of a bra cup. This second face 42 is knitted to provide it with a particularly soft feel. The three-dimensional knitted fabric may be produced from threads or combinations of threads of different types, for example polyester, polyamide, or elastane. Each of the threads used can be produced from one or more filaments. The two faces 41 and 42 of the three-dimensional knitted fabric 4 are separated from each other by a generally uniform thickness e2 that is greater than 1 mm. Advantageously, for a particularly soft feel, this thickness e2 is between 2.5 mm and 4 mm.

To form a bra cup that integrates contoured padding for a "push-up" effect that raises and adds curve to the chest, the foam layer 3 of thermoformable polyurethane is compressible and of significant thickness. The layer 3 is preferably formed of one piece having a generally uniform thickness e1, this thickness being sufficient for forming the desired padding in areas where the mold is arranged so as to barely compress the foam. A thickness e1 of about 7 mm for example can be provided.

The mold, cavities 6 and 7 have facing inner surfaces 60 and 70 of a shape suitable for the final shape of the bra cup(s) to be molded. Starting from the position represented in FIG. 1, the cavities 6 and 7 are then moved closer together, which compresses the composite assembly 5 to a greater or lesser extent in predetermined areas so as to form a cup in which the thickness of the foam layer 3 of thermoformable polyurethane varies depending on the area.

Figure 2:
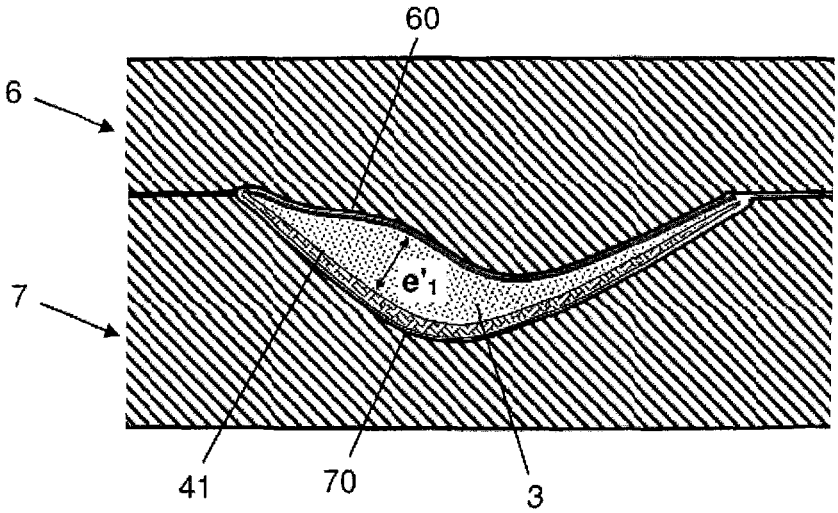
FIG. 2 schematically represents a sectional view of the composite assembly of FIG. 1 after the mold has been closed to shape the final form of the bra cup.

As represented in FIG. 2, in a padding area of the cup, the thickness of the foam layer 3 has a maximum value e'1 which can be almost equal to the thickness e1 of the foam layer 3 before molding. In the areas of the cup that are not in the padding area, the foam layer 3 has been substantially compressed and therefore has a higher density than the initial density of the foam. As the polyurethane foam is thermoformable, the mold is heated so that the heat sets the shape of the foam and therefore the shape of the cup.

Figure 3:
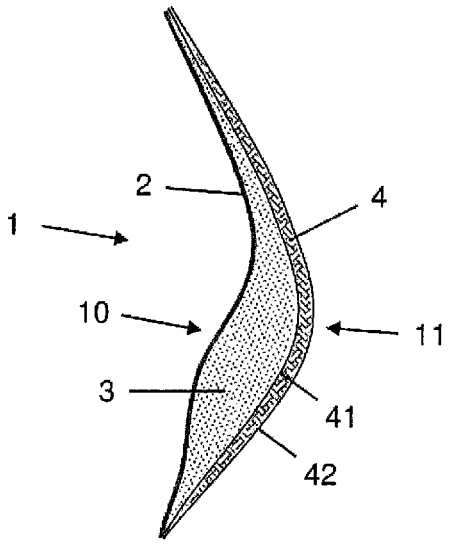
FIG. 3 schematically represents a sectional view of the bra cup after it is unmolded.

As represented in FIG. 3, the cup 1 when unmolded retains the shape imposed in the mold. The cup 1 has a generally concave inner face 10 covered with the inner fabric 2, and a generally convex outer face 11 covered with three-dimensional knitted fabric 4. During the cup thermoforming operation, the thickness e2 of the three-dimensional knitted fabric 4 is generally not reduced significantly in comparison to the thickness of the knitted fabric 4 in the initial laminate 5.

In a second embodiment of a bra cup according to the invention, there is no formation of a contoured padding with variations in the thickness of the polyurethane foam layer. The thickness e1 of the foam layer 3 in the laminate can therefore be smaller than in the first embodiment, and for example can be between 1 mm and 4 mm.

Figure 4:
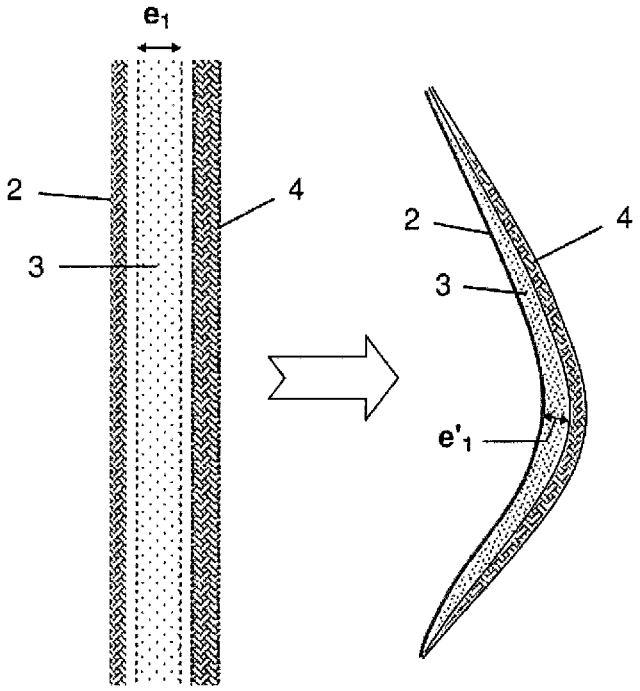
FIG. 4 schematically represents the creation of a bra cup according to a second embodiment of the invention.

As represented in FIG. 4, starting with a composite assembly in the form of a laminate similar to the laminate 5 of the first embodiment but with a lesser thickness e1 of the foam layer 3, a bra cup is molded and thermoformed that is similar to the cup 1 of FIG. 3, but without providing a "push-up" effect since the thickness e'1 of the thermoformed foam layer 3 has relatively little variation.

Referring to FIG. 1, when bonding the three-dimensional knitted fabric 4 to the foam layer 3, a hot melt adhesive 8 may be applied to the first face 41 of the three-dimensional knitted fabric using a roller 8 containing the molten adhesive. Advantageously, the roller has a cylindrical wall provided with adhesive dispensing holes distributed so as to form regularly spaced dots of adhesive. Preferably, the composite assembly 5 is left at room temperature for a predetermined period that is typically at least several hours, before the cup molding step. The hot-melt adhesive 3 is advantageously designed such that after said predetermined period, the adhesive is not reactivated during the thermoforming of the composite assembly 5. In other words, the heating of the adhesive that occurs when thermoforming the cup will not liquefy or spread the glue, and so there is no risk of any relative sliding or detachment of the layers of the composite assembly.

The invention claimed is:

1. A bra cup molded by thermoforming, having a generally concave inner face and a generally convex outer face, comprising a layer of thermoformable polyurethane foam as well as an inner fabric and an outer fabric, the inner fabric being bonded to the foam layer on the concave inner face, wherein the outer fabric, which defines the convex outer face of the bra cup, is bonded to the foam layer, and wherein the outer fabric is composed of a three-dimensional knitted fabric comprising a first face and a second face separated from one another by a thickness of the three-dimensional knitted fabric that is greater than 1 mm.

2. The bra cup according to claim 1, wherein the thickness of the three-dimensional knitted fabric is between 2.5 mm and 4 mm.

3. The bra cup according to claim 1, wherein the foam layer is compressible and is formed of a single piece.

4. The bra cup according to claim 1, wherein the foam layer has a density and a thickness which vary in different areas of the bra cup, said foam layer being formed from a layer of compressible foam of a generally uniform thickness that is compressed to a greater or lesser extent depending on said areas of the bra cup.

5. A method for manufacturing a bra cup, comprising:

providing a flexible, layered, composite assembly, which comprises three superposed layers, including a foam layer of thermoformable polyurethane foam being bonded to and extending between an inner fabric and an outer fabric so as to define the three superposed layers; and molding the bra cup within a mold by thermoforming the composite assembly, so that after the molding, the inner fabric layer defines a concave inner face of the bra cup and the outer fabric layer defines a convex outer face of the bra cup, wherein the outer fabric is composed of a three-dimensional knitted fabric comprising a first face and a second face separated from each other by a thickness of the three-dimensional knitted fabric that is greater than 1 mm, and wherein in a bonding step preceding the bra cup molding step, said first face and the foam layer are bonded together.

6. The method according to claim 5, wherein the composite assembly used is in laminate form, and the foam layer and the three-dimensional knitted fabric of said composite assembly each have a generally uniform thickness.

7. The method according to claim 5, wherein the mold has a shape that is suitable for the final shape of the bra cup.

8. The method according to claim 7, wherein the shape of the mold is adapted to compress the composite assembly to a greater or lesser extent in predetermined areas, so that the thickness of the foam layer of the bra cup varies according to said predetermined areas.

9. The method according to claim 5, wherein, during the bonding step, a hot melt adhesive is applied in a distributed manner onto the first face of the three-dimensional knitted fabric so as to form dots of adhesive with space between them, the foam layer is laminated with the three-dimensional knitted fabric, and the composite assembly is left at room temperature for at least a predetermined period before the bra cup molding step, the hot melt adhesive being such that, after said predetermined period, the adhesive is not reactivated during the thermoforming of the composite assembly.

10. The method according to claim 9, wherein, during the bonding step, the hot-melt adhesive is applied onto the first face of the three-dimensional knitted fabric by means of a roller containing the molten adhesive, the roller having a cylindrical wall provided with adhesive dispensing holes distributed so as to form the dots of adhesive.

11. The method according to claim 5, wherein the shape of the foam layer is set by heat when thermoforming the composite assembly.

12. A three layer bra cup molded by thermoforming a flexible, layered, composite assembly, comprising:

a foam layer of thermoformable polyurethane foam that is cup-shaped;

an inner fabric bonded to the foam layer and delimiting a generally concave inner face of the bra cup; and an outer fabric composed of an outer three-dimensional knitted fabric comprising a first face and a second face separated from one another by a thickness greater than 1 mm, the first face adhering to the foam layer at the opposite side from the inner fabric, and the second face defining a generally convex outer face of the bra cup.

13. The bra cup according to claim 12, wherein the three-dimensional knitted fabric has a uniform thickness and the inner fabric is thinner than the outer fabric.

* * * * *